United States Patent [19]

Lemire et al.

[11] Patent Number: 4,805,322

[45] Date of Patent: Feb. 21, 1989

[54] EXCAVATING BLADE ASSEMBLY

[76] Inventors: Antoine-Noël Lemire, 528 Route 132, Baieville, Quebec, Canada, JOA lGO; Christian Lemire, 5390 Aubert, Trois-Rivieres Quest, Quebec, Canada, G8Y 5C4; Paul Lemire, Route 132, Baieville, Quebec, Canada, JOA lGO

[21] Appl. No.: 9,513

[22] Filed: Jan. 30, 1987

[51] Int. Cl.[4] ..... E02F 3/80

[52] U.S. Cl. ..... 37/118 R; 172/445.1; 172/448; 172/701.1

[58] Field of Search ..... 37/118 R, 126 R, 124, 37/128, DIG. 12, 117.5, 142.5, 141 R, 266, 268, 267, 279–284, 108 R; 172/448, 445.1, 443, 451, 439, 701.1, 701.3

[56] References Cited

U.S. PATENT DOCUMENTS

| | | | |
|---|---|---|---|
| 2,755,573 | 7/1956 | Bannister | 37/144 |
| 2,792,650 | 5/1957 | Kenyon | 37/283 |
| 3,043,032 | 7/1962 | Discenza | 37/117.5 |
| 3,218,740 | 6/1963 | White | 172/701.1 |
| 3,469,330 | 9/1969 | Hood et al. | 37/117.5 |
| 3,523,621 | 8/1970 | Anderson | 37/118 R |
| 4,082,150 | 4/1978 | Winkles | 172/770 |

FOREIGN PATENT DOCUMENTS

| | | | |
|---|---|---|---|
| 701538 | 1/1965 | Canada . | |
| 1017561 | 9/1977 | Canada | 37/279 |

*Primary Examiner*—Edgar S. Burr
*Assistant Examiner*—James A. Lisehora

[57] ABSTRACT

A blade assembly is adapted to be connected to the conventional three-point hitch of a farm tractor. A generally horizontal boom pivotally carries at its rear end a blade bucket which is swingable by means of a pair of double-action hydraulic jacks pivoted to the blade and to the boom. The front end of the boom is adapted to be pivotally connected to the pair of laterally-spaced hitch lever arms of the tractor hitch system. A spacer frame upstands from and is pivotally connected to the front ends of the boom. A central lever arm is pivotally connected intermediate its ends to the upper portion of the spacer frame. A central link pivotally interconnects the front end of said central lever arm with the front portion of the boom. A double-acting hydraulic jack interconnects the boom with the pivotal connection between the central lever arm and the link. The link, the boom, the spacer frame and the portion of the central lever arm which is rearward of the spacer frame form the sides of deformable quadrilateral structure which causes raising and lowering of the boom by extension and retraction of the last-named hydraulic jack respectively. The blade itself is characterized by a main panel bent to form three flat plate sections at an angle one with respect to the other. The blade can enter the ground and shovel back the earth with the minimum power reqirement.

6 Claims, 4 Drawing Sheets

EXCAVATING BLADE ASSEMBLY

FIELD OF THE INVENTION

The present invention relates to an excavating blade and to a boom assembly for the blade adapted to be connected to the conventional three-point hitch of farm tractors.

BACKGROUND OF THE INVENTION

Back-filling excavating blade assemblies are known, which are adapted to be fixed to a farm tractor and be operated by the conventional hydraulic system of said tractor However, such known assemblies require a special frame adapted to be detachably fixed to the underside of the tractor body. Such a frame must be removed when the tractor is used for other purposes Moreover, such frames must vary in size, shape and as to the location of the connecting brackets, depending on the various tractor models.

The three-point hitch system of a farm tractor cannot be used for operating an excavating blade, because no downward pressure can be exerted on the blade, since the hydraulic system of the three-point hitch system is normally capable of only raising the agricultural implement attached thereto. Also in conventional systems, the back-filling blade is curved and, therefore, is subjected to frictional forces from the earth when digging. It follows that the width of excavation is rather limited.

OBJECTS OF THE PRESENT INVENTION

The main object of the present invention is to provide a back-filling blade and boom assembly adapted to be attached to the conventional three-point hitch of a farm tractor and which can excavate at a relatively important depth Another object of the present invention is to provide a back-filling excavating blade shaped so as to reduce friction with the earth during excavation and shovelling Another object of the present invention is to provide an assembly of the character described, in which the blade can be manipulated to excavate, shovel and scrape the earth.

Another object of the invention is to provide an assembly of the character described, which has adjustment means enabling it to be attached to three-point hitches of different makes of farm tractors.

SUMMARY OF THE INVENTION

The conventional three-point hitch system at the back of farm tractor body includes a central hitch bracket, a pair of laterally-spaced hitch lever arms pivoted for up-and-down movement to the back of the tractor body below the level of the central hitch bracket, a pair of laterally-spaced lifting levers disposed over the respective lower hitch levers and connected thereto by links and a power means to operate said lifting levers in order to raise the lever arms. The lifting levers are interconnected for synchronized up-and-down movement and are power operated by a single-acting hydraulic system, which can only lift these levers. The assembly of the present invention includes a blade having an upper portion and a lower scraping edge, an elongated boom having a rear end pivotally connected to the upper portion of the blade and a front end adapted to be pivotally connected to the front end of the boom, a central lever arm is pivoted to the upper portion of the spacer frame intermediate the ends thereof, The front end of the central lever arm is adapted to be pivotally connected to the hitch bracket. A central link pivotally interconnects the front portion of the boom to the front end of the central lever arm. A main double-acting hydraulic jack pivotally interconnects the pivotal connection between the central lever arm and the link and a portion of the boom rearward of the spacer frame. Double-acting hydraulic jacks connected to the front portion of the boom and to the blade serve to swing the blade relative to the boom. Extension and retraction of the main hydraulic jack positively causes raising and lowering of the boom respectively. It follows that the blade, when lowered, pushes against the ground to the extent that the rear wheels of the farm tractor are lifted off the ground. There results an important weight transfer directly on the blade.

To prevent damage to the tractor hydraulic system, the links of the three-point hitch system are disconnected from the lower hitch lever arms. A stabilizer frame is preferably pivoted to the spacer frame and the links are pivotally connected thereto to stabilize the spacer frame against lateral tilting. Preferably, the portion of the central lever arm extending forwardly of the spacer frame is made of different sections, so as to adjust its length and its angular position with respect to the rearward portion of the central lever arm, so as to connect the assembly to three-point hitch systems of various makes of farm tractors.

DETAILED DESCRIPTION OF THE PREFERRED EMBODIMENT OF THE INVENTION

Figure 1:
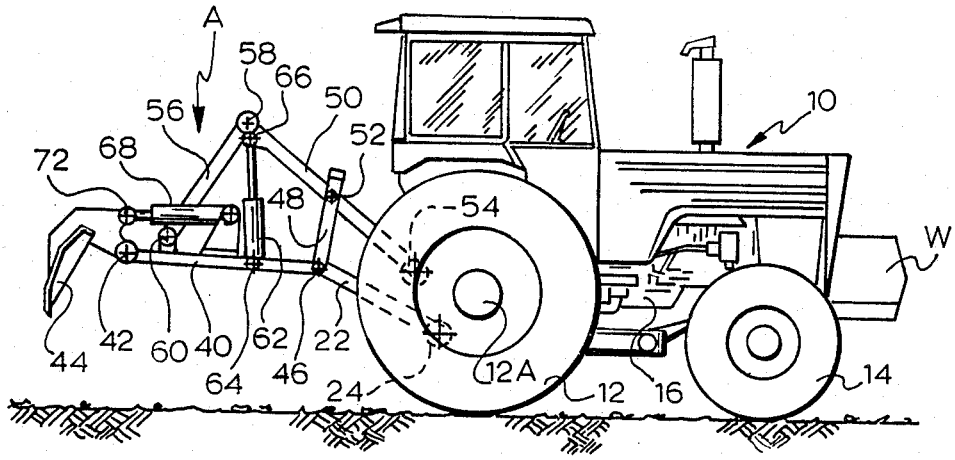
FIG. 1 is a side elevation of a farm tractor equipped at its rear end with the excavating blade assembly in accordance with the invention and shown in lifted position.
Figure 2:
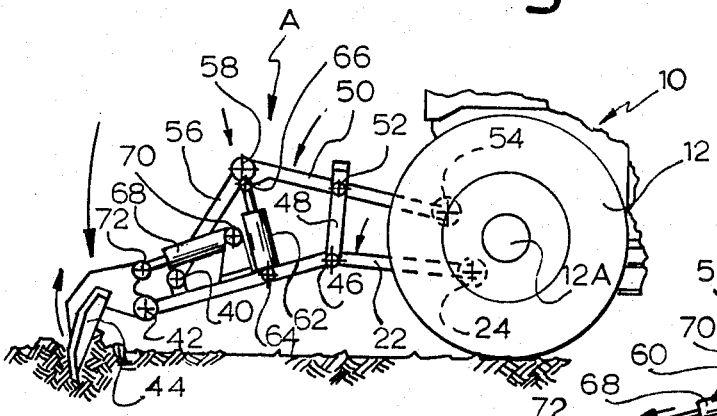
FIGS. 2 to 4 are side elevations of the excavating blade assembly sequentially showing various operative positions, the rear portion of the farm tractor being shown.
Figure 4:
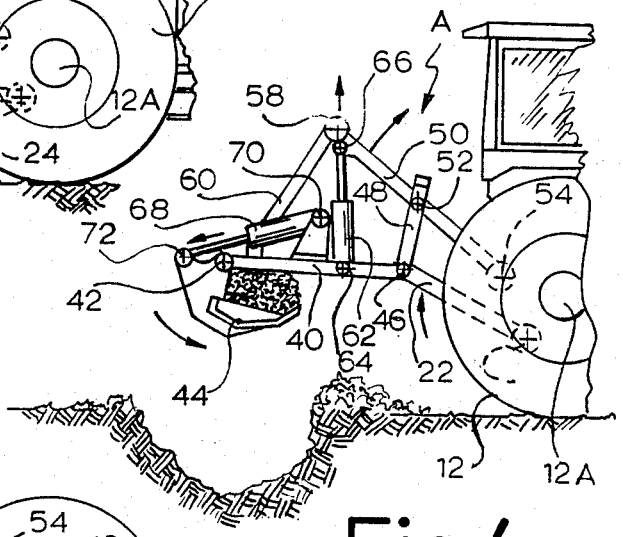
Figure 3:
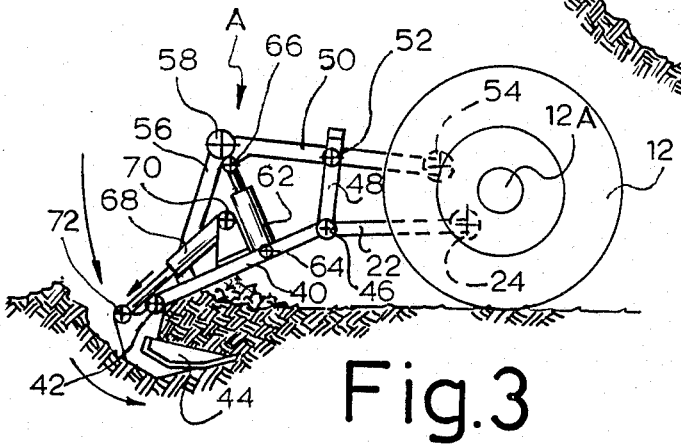
Figure 5:
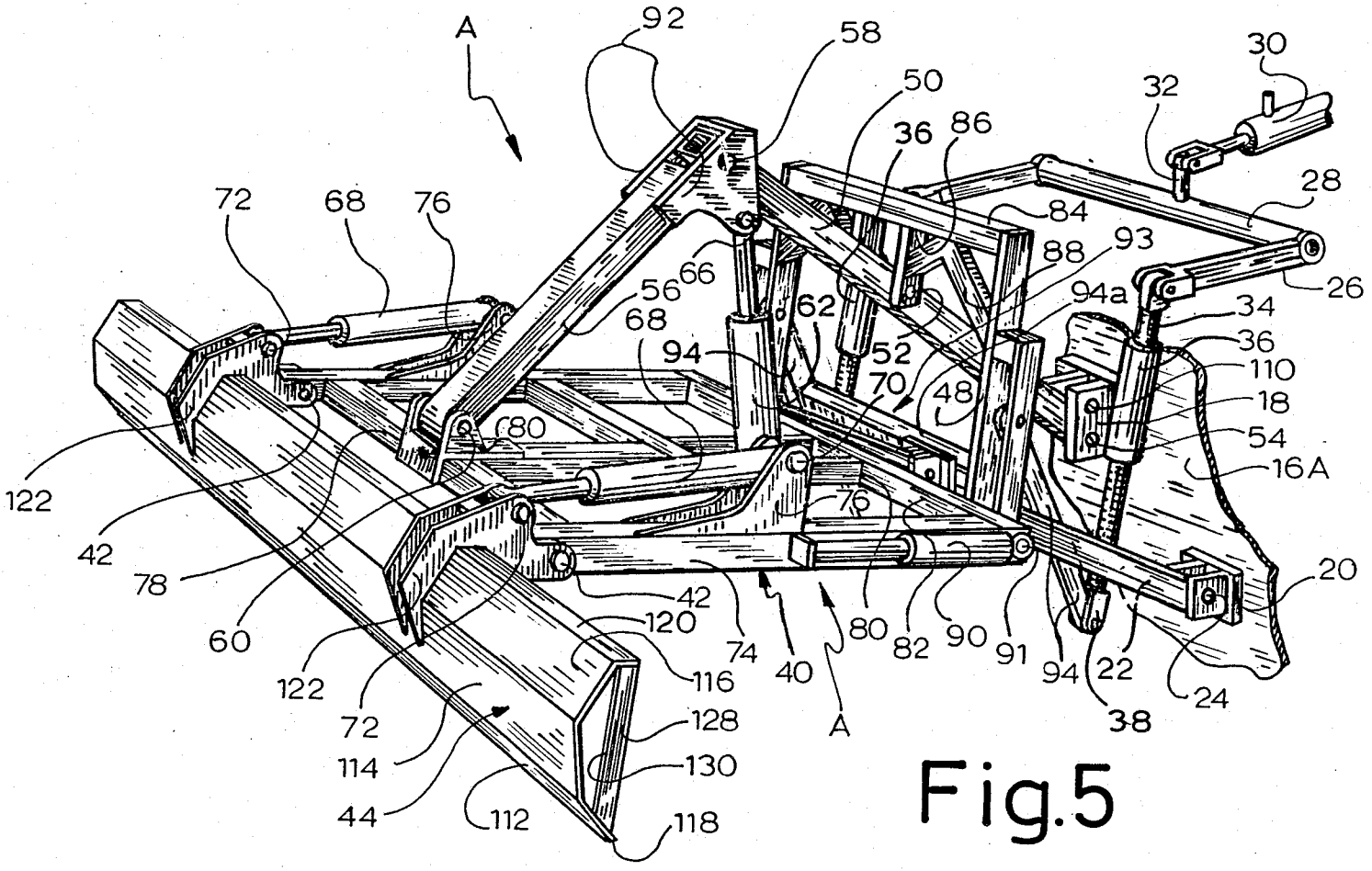
FIG. 5 is an enlarged perspective view of the excavating blade assembly connected to a farm tractor, partially shown.

A typical farm tractor 10 is shown including large rear wheels 12 with an axle 12A, small front wheels 14, a main body 16 and equipped with a weight W fixed to the front of body 16. The conventional three-point hitch of such a farm tractor is mounted at the rear part 16A of the tractor body 16. As schematically shown in FIG. 5, this hitch system includes a central hitch bracket 18, generally disposed above the axle 12A and behind the same. A pair of laterally-spaced lower pivot brackets 20 are secured to the body part 16A at a lower level than axle 12A and forwardly of the hitch bracket 18. A pair of implement levers 22 are freely pivoted at 24 to the respective brackets 20 for free up-and-down movement at the back of the tractor. The three-point hitch system further includes a pair of laterally-spaced lift levers 26 respectively extending over the implement levers 22 and each rigidly interconnected by a transverse operating rod 28 which is journalled in the tractor body 16 and forms a pivot axis for the lift levers 26. The lift levers are arranged for up-and-down movement but only their up-movement is under the power of the tractor hydraulic system, as schematically represented by a single-acting hydraulic jack 30 operating a lever arm 32 fixed to the operating rod 28 and which can only raise lift levers 26. Lift levers 26 are normally connected to the implement levers 22 by means of links 34 which include a turnbuckle assembly 36 to adjust the length of these links. These links are releasably connected at their lower ends by the clevis 38 to an outer portion of the respective implement levers 22. The assembly A of the present invention is adapted to be connected to this three-point conventional farm tractor hitch system.

The assembly A includes a boom 40 normally extending in horizontal position rearwardly of a farm tractor 10, the rear end of which is pivotally connected at 42 to the upper portion of a back filling excavating blade 44 which will be more specifically described hereinafter.

The front end of the boom 40 is adapted to be pivotally connected at 46 to the rear end of the implement levers 22. An upstanding spacer frame 48 extends upwardly from the rear end of the boom 40 being pivoted at its lower end to the pivot 46. A central lever arm 50 is pivoted intermediate its ends to the upper portion of spacer frame 48 by means of pivot bolt 52 while its front end is pivoted to the hitch bracket 18 by means of pivot pin 54. The central lever arm 50 extends rearwardly of the tractor above the central portion of the boom 40. The pivot pin 52 is located about midway from the ends of the central lever arm 50. A central link 56 is pivoted at its rear end by pivot pin 58 to the front end of central lever arm 50 while the other end of link 56 is pivoted at 60 to a front portion of boom 40 adjacent the pivot 42 of blade 44. A double-acting hydraulic jack 62 is pivoted at its lower end at 64 to the boom 40 forwardly of the spacer frame 48 The upper end of the hydraulic jack 62 is pivoted to the interconnection between the central lever arm 50 and link 56 as shown at 66. The assembly further includes a pair of blade swinging double-acting hydraulic jacks 68, each pivoted to the boom 40 at 70 and to the upper portion of the blade 44 at 72.

As shown in FIG. 5, the boom 40 defines a generally flat frame of rectangular shape and of tubular construction. The longitudinal sides 74 of this boom are directly pivoted at their rear end to the top portion of the blade 44 by laterally spaced pivots 42. Ear brackets 76 upstand from and are welded to these longitudinal members 44 for pivotally supporting at 70 the blade actuating hydraulic jacks 68. The rear cross-member 78 of the frame defining the boom 40 carries at its middle bracket ears 80 which are pivotally connected to the central link 56. The pivot pin 64 of the main hydraulic jack 62 is carried by central longitudinal members 80 of the boom frame. The front cross-member 82 of the boom frame carries a laterally spaced pair of ears forwardly protruding therefrom to mount the pivot pin 46 pivotally interconnecting the lower end of the spacer frame 48 and the implement levers 22. The spacer frame 48 is of inverted U-shape and its upper cross-member 84 supports a pair of downwardly-extending centrally located plates 86 which carry the pivot 52 between the spacer frame 48 and the central lever arm 50. These plates 86 are braced by braces 88. Adjustable legs 90 are pivoted at 92 to the ends of the front cross-member 82 as shown in FIG. 5 and can take a position at substantially right angle to the boom 40 to support the front end of the boom above ground. When not in use, they are folded alongside the boom-40 as shown in FIG. 5.

The link 56 includes a yoke 92 secured thereto. Yoke 92 is an inverted U-shape member providing the pivotal connections 58 and 66. A stabilizer-frame 93 is provided: it comprises two longitudinal arms 94 pivoted at 95 to each side of the spacer frame 48 and adapted to be releasably connected at their free ends to the clevis 38 of the respective links 34 of the three-point hitch system. Stabilizer frame 93 also includes a transverse bar **94*a*, which rigidly interconnects arms 94** intermediate their ends.

Figure 6:
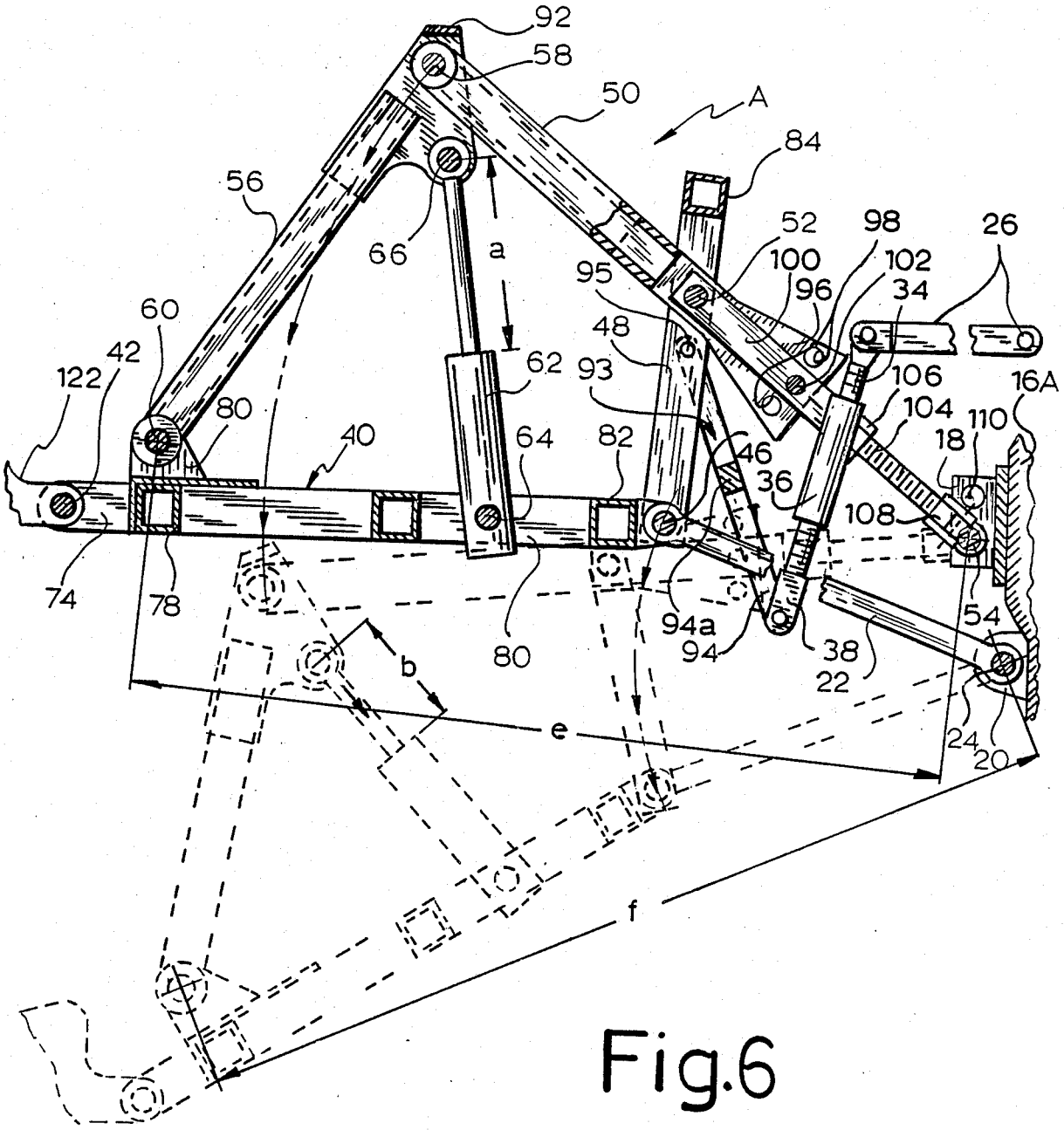
FIG. 6 is a partial longitudinal section of the assembly as connected to the rear of a partially-shown tractor.

As shown in FIG. 6, the central lever arm 50 is composed of several sections for adjusting the assembly to hitch systems of various makes of farm tractors, i.e. in accordance with the relative position of the hitch bracket 18 and implement lever brackets 20. More particularly, the main member of the lever arm 50 is extended forwardly of the spacer frame 48 to be terminated in a pair of triangular plates 96 provided with registering holes 98 laterally spaced , on each side of the center line of the main member. A bar 100 extends between the two plates 96 and is connected by pivot pin 52 and is selectively secured to the plates 96 by a pin 102 extending through selected pairs of holes 98. This permits angular adjustment of bar 100 relatively to the main member of the lever arm 50. Bar 100 is further extended by a bolt 104 screwed therein for adjustment of the overall length of the lever arm 50 and the bolt is fixed in adjusted position by a lock nut 106. The coupling member 108 at the end of the bolt 104 can be selectively secured within any one of two holes 110 of the hitch bracket 18.

Figure 7:
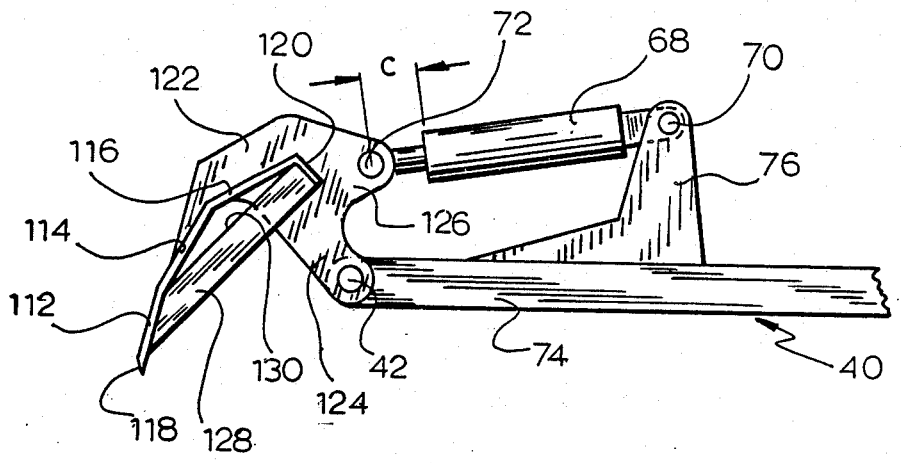
FIGS. 7 and 8 are enlarged partial side elevation views of the excavating blade assembly of FIGS. 1 and 3 showing the relative displacement of the blade.
Figure 8:
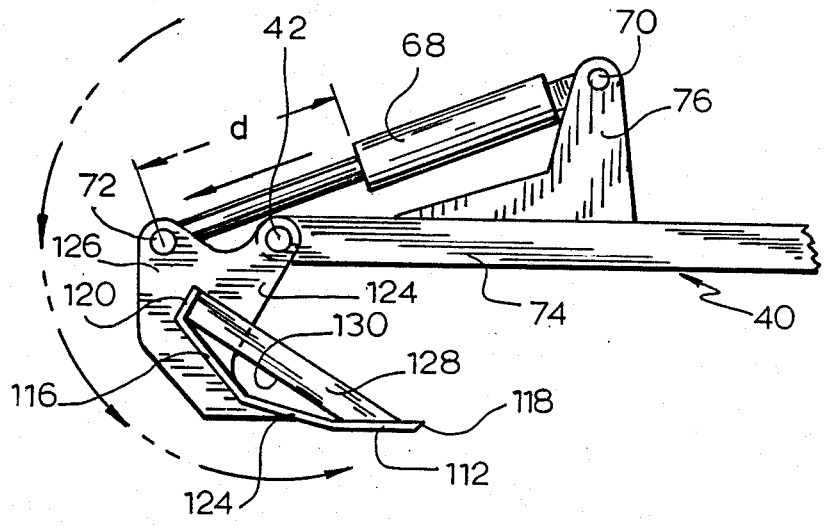

Referring to FIGS. 5, 7, and 8, the excavating blade 44 consists of a generally rectangular panel bent to form three panel sections 112, 114, and 116 which are flat and substantially of equal width. The lower panel section 112 makes an angle of about 15° with the intermediate panel section 114 while the latter makes an angle of about 30° with the upper panel section 116. Lower panel section 112 defines a bevel free edge 118 which forms a scraping edge. The upper panel section 116 is extended by an additional panel section 120 of smaller width than the remaining panel sections and making an included angle of about 105° with the adjacent panel section 116. Near each end of the blade a pair of spaced parallel ears 122 are secured to the panel and, more particularly, to the panel sections 114, 116, and 120. Ears 122 define a first extension 124, which extends from the panel in the direction of the additional panel section 120 and beyond the latter and has at its outer end a hole for the pivot pin 42, so that the latter is spaced an appreciable distance from the concave side of the blade. Ears 122 are further provided with a second extension 126, which protrudes from the additional panel section 120 in a direction away from the scraping edge 118. This second extension 126 has a hole for the pivotal connection 72 of the hydraulic jacks 68. The assembly is used as follows: the front end of the boom 40 is pivotally connected to the rear end of the lower pair of hitch levers 22 by pins 46 and the front end of the central lever arm 50 is pivotally connected by pin 54 to the hitch bracket 18. The lift levers 26 are allowed to take their limit downward position. The clevis 38 of each hitch link 34 is disconnected from the implement levers 22 and attached to the front end of arms 94 of stabilizer frame 93. The tractor power motor 30 to actuate the lift levers 26 of the hitch system is not used, so that these lift levers 26 as well as the implement levers 22 are free to pivot upwardly. Raising and lowering movement of the blade is solely achieved by operation of the main double-acting hydraulic jack 62. Swinging action of the blade 44 is achieved by the hydraulic jacks 68. The central link 56, the boom 40, the spacer frame 48, and the rearward portion of the central lever arm 50 with respect to the pivotal connection to the spacer frame 48 forms the sides of a deformable quadrilateral structure which, because the lever arm 50 is pivotally attached to the hitch bracket 18, causes raising and lowering of the boom 40 by extension and retraction respectively of the main hydraulic jack 62. Boom 40 is locked in a given position whenever jack 62 is not actuated.

Stabilizer frame 93 serves to prevent lateral tilting of the spacer frame 48. Advantage is taken of the fact that, in the internal mechanism of the farm tractor, the two lift levers 26 are rigidly interconnected by a cross rod 28 for synchronized up-and-down movement. Therefore, since the arms 94 of the stabilizer frame 93 are pivotally attached to the links 34, it follows that lateral tilting of the spacer frame 48 is prevented, while at the same time permitting full up-and down movement of the spacer frame 48. It has been found that the boom 40 can pivot vertically through an angle of about 60° and that this boom can take a lower limit downwardly-inclined position of about 50° with respect to the horizontal. Therefore, it is possible to dig a trench of appreciable depth.

Such downwardly-inclined position of the boom 40 would not be possible to obtain if this boom was part of a conventional implement attached to the three-point system of the tractor, with the hydraulic cylinder 30 of the tractor made double-acting. Such a system would include the boom 40 pivotally connected at its forward end to the implement levers 22 and carrying a digging blade at its rear end, with the boom attached by a tie-beam to the bracket 18. In such a system, the boom, while being lowered by the implement levers 22, would not become downwardly inclined; but, on the contrary, will become upwardly inclined to a small extent. Thus, the object of the invention would be completely reversed.

Due to the particular construction of the blade, it has been found to reduce the friction with the earth when digging as compared to a curved blade. Retainer plates 128 at each end of the blade and which are secured to and extend between the additional panel section 120 and the lower panel section 112 serve to retain the earth, so that the blade functions as a bucket or shovel. The space left between the inner longitudinal edge 130 struts 128 and the bottom of the blade facilitates self-cleaning of the blade. It is known that earth accumulates at the ends of the blade when these ends are fully closed.

What we claim is:

1. A back filling blade assembly adapted to be mounted to the conventional rear three-point hitch system of a farm tractor, said hitch system including a central hitch bracket fixed to the back of the tractor body and a pair of laterally-spaced first hitch lever arms pivoted for up and down movement at their front ends to the back of said tractor body below the level of said central hitch bracket and having free rear ends, said assembly comprising a blade having an upper portion and a lower scraping edge, an elongated boom adapted to extend rearwardly of said tractor, having a rear end pivotally connected to the upper portion of said blade and a front end adapted to be pivotally connected to the rear ends of said first hitch lever arms, a central lever arm extending centrally over said boom, having a front end adapted to be pivotally connected to said central hitch bracket and having a rear end, an upstanding spacer frame extending between said boom and said central lever arm and pivotally connected at its upper portion to an intermediate portion of said central lever arm and at its lower portion to the front end of said boom, a link pivotally interconnecting the rear end of said central lever arm and the rear portion of said boom and an upstanding double-action hydraulic jack having an upper end pivotally connected to the pivotal connection of said central lever arm with said link and a lower end pivoted to said boom intermediate its front and back ends, whereby, when the front ends of said boom and of said central lever arm are respectively connected to the rear end of said first hitch lever arms and to said hitch bracket, said link, said boom, said spacer frame and the portion of said central lever arm which is located rearward of said spacer frame form the sides of a deformable quadrilateral structure which causes raising and lowering of said boom by extension and retraction of said hydraulic jack respectively.

2. The assembly of claim 1, further including additional double-acting hydraulic jacks pivoted to said boom and to said blade to pivot said blade about the rear end of said boom.

3. The assembly as defined in claim 2, wherein said blade comprises a panel of generally rectangular shape and defining at least three flat panel sections of about equal width and each inclined between about 15° and 30° relative to an adjacent panel section, one panel section having a free longitudinal edge defining a scraping edge, the panel section furthest away from said one panel section defining the upper portion of said blade and extended by an additional panel section of smaller width than the three first-named panel sections and making an included angle of about 105° with said furthest away panel section, struts secured to and extending between said additional panel section and said one panel section at both ends of said panel, a pair of ears fixed to said panel at right angles thereto and having a first extension protruding from said panel in the direction of and beyond said additional panel section, said first extension having a first pivot hole at its free end for pivotal connection of said blade to said rear end of said boom, said pair of ears also having a second extension protruding from said additional panel section in a direction away from said scraping edge and having a second pivot hole at its free end for pivotal connection to said additional hydraulic jacks.

4. The assembly as defined in claim 2, wherein the hitch system of said farm tractor is of the type further including a pair of laterally-spaced power-operated second hitch levers arms pivoted at the back of said tractor body above said hitch bracket and extending above and generally parallel to the respective first hitch levers arms, said second hitch lever arms being rigidly interconnected for synchronized up-and-down pivotal movement, power means connected to said second hitch lever arms for upwardly pivoting the same, second links interconnecting the free ends of said second hitch lever arms and the rear end portion of said first hitch lever arms, and means to disconnect said second links from said first hitch levers arms, said assembly further including a stabilizer frame having a rear end pivotally connected to said spacer frame intermediate the ends of the latter, and having a front end adapted to be pivotally connected to said second links, whereby said second hitch lever arms, due to their rigid interconnection, will, through said stabilizer frame, stabilize said spacer frame against lateral tilting, while said stabilizer frame will allow up-and-down movement of said spacer frame.

5. A back-filling excavating blade comprising: a panel of generally rectangular shape and defining at least three flat panel sections of about equal width and each inclined between about 15° and 30° relative to an adjacent panel section, one panel section having a free longitudinal edge defining a scraping edge, the panel section furthest away from said one panel section extended by an additional panel section of smaller width than the width of the three first-named panel sections and making an included angle of about 105° with said furthest away panel section, struts secured to and extending between said additional panel section and said one panel section at both ends of said panel, a pair of ears fixed to said panel at right angles thereto and having a first extension protruding from said panel in the direction of and beyond said additional panel section, said first extension having a first pivot hole at its free end for pivotal connection of said blade to a supporting boom for swinging movement of said blade relative to said supporting boom, said pair of ears also having a second extension protruding from said additional panel section in a direction away from said scraping edge and having a second pivot hole at its free end for pivotal connection to a hydraulic jack for swinging movement of said blade.

6. An excavating blade as defined in claim 5, wherein said struts have an inner longitudinal edge which is spaced from said panel to define a space at each end of the panel between the strut and the panel to facilitate self-cleaning of said blade.

* * * * *